United States Patent [19]

Marklund et al.

[11] 4,330,973

[45] May 25, 1982

[54] UNIT PREFERABLY OF WOOD

[76] Inventors: Karl-Gerhard Marklund, Postlåda 1290; Hakan Larsson, Postlada 1287, both of Bjurholm, Sweden, S-910 11; Johnny Sandström, 11 Märtavägen, Själevad, Sweden, S-890 23

[21] Appl. No.: 161,337

[22] Filed: Jun. 20, 1980

[30] Foreign Application Priority Data

Aug. 24, 1979 [SE] Sweden ..... 7907074

[51] Int. Cl.[3] ..... E04B 1/10; E04C 3/12

[52] U.S. Cl. ..... 52/233

[58] Field of Search ..... 52/233

[56] References Cited

U.S. PATENT DOCUMENTS 2,130,231 9/1938 Forciea ..... 52/233

2,525,659 10/1950 Edson et al. ..... 52/233

3,189,950 6/1965 Johnson ..... 52/233

FOREIGN PATENT DOCUMENTS 1411558 8/1965 France ..... 52/233

*Primary Examiner*—Alfred C. Perham

*Attorney, Agent, or Firm*—Fisher, Christen & Sabol

[57] ABSTRACT

This invention relates to a wood log unit, which in at least one end zone includes a portion with full cross-section while the portion inside thereof constitutes of at least one part with half a cross-section. The transition between the portion with full cross-section and the portion inside thereof consists of a recess, in which the portion with full cross-section fits and of a plane surface, which in principle is one quarter of the cross-sectional area for the full cross-section and extending perpendicularly to the longitudinal direction of the unit.

12 Claims, 4 Drawing Figures

UNIT PREFERABLY OF WOOD

BACKGROUND OF THE INVENTION

1. Field of the Invention

This invention relates to a wood log unit, which in at least one end zone includes a portion with full cross-section while the portion inside thereof at least partially has half a cross-section.

2. Description of the Prior Art

When constructing buildings of timber after conventional or generally known methods, insulation is applied on the inside or outside of the timber wall in order to obtain a satisfactory k-value. Insulation carried out in this way is expensive and tedious, because in most cases studding and additional inner or outer facing are required. The known log units with built-in insulation usually are made of log boarding, i.e. not of timber logs with full cross-section. The insulation, besides, often is a soft one, which implies that log boardings constituting the surface layers must be connected to distance members.

The present invention has the object to produce a log unit, which can be applied without insulation, with conventional insulation or be provided with built-in insulation. The log unit is self-supporting and, thus, need not be combined with studding.

As to its outer appearance, the log unit corresponds to an entire log.

The strength and bearing capacity exceed the values of a conventional corner joint log. Torsion and seasoning are reduced substantially compared with other corner joint structures.

SUMMARY OF THE INVENTION

The objects of the present invention are achieved with a log unit comprising two end portions and an inner portion, at least one end portion being of full cross-section and said inner portion being at least partially of half cross-section. The transition between an end portion and the inside portion comprises a recess and a plane surface. The recess extends in the longitudinal direction of the unit and is shaped so that an end portion of another unit fits into it. The plane surface is about one quarter of the cross-sectional area of the end portion. It extends substantially perpendicular to the longitudinal axis of the log unit and connects to the flat surface of the inner portion with half a cross-section. The log unit has a groove on the top surface and a tongue on its bottom surface for engagement with other units.

BRIEF DESCRIPTION OF THE DRAWINGS

An embodiment of the invention is described in the following, with reference to the accompanying drawings, in which.

DESCRIPTION OF THE PREFERRED EMBODIMENTS

Figure 1:
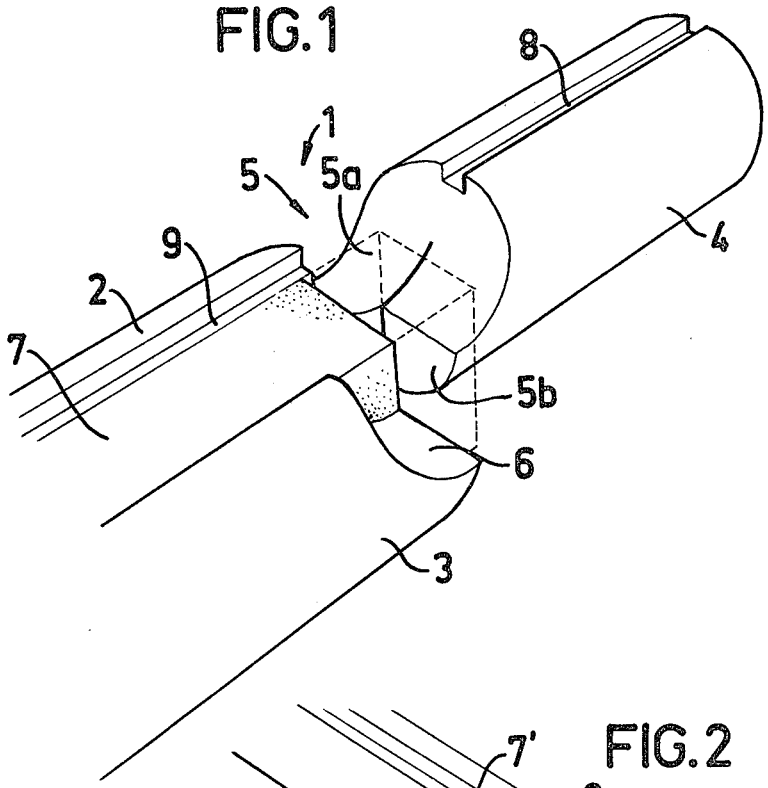
FIG. 1 is a perspective view of a log unit according to the invention.

The log unit 1 shown in FIG. 1 is made of a cylinder-turned log, which is provided with groove and tongue. The log is provided with a semi-circular recess, which extends down to half the log height and is located in one log end zone.

For manufacturing the log unit 1 shown in FIG. 1, the log is centre-cut in its longitudinal direction all the way to half the width of the recess, whereafter transverse to the longitudinal log direction a cut is made in to the log pith.

Two log halves 2 and 3 now are formed in principle, of which one 2 has an end portion 4 with circular cross-section. The transition 5 between the end portion 4 and log half 2 consists of a recess 5*a* with the same curvature radius as the end portion 4 and of a plane surface 5*b* with a cross-section of a quarter of a circle.

The second log half 3 has at one end a recess 6 with an extension of a quarter of a circle.

The log unit 1 shown in FIG. 1 now is produced in that a stave 7 of self-supporting insulation and with rectangular cross-section is attached between the log halves 2,3 and connected thereto by glueing. Thereby one log half 3 is displaced away from the recess 5 through a distance corresponding to the thickness of the insulation stave 7.

At the log unit 1 shown in FIG. 1, the insulation stave 7 extends all the way to the starting zone of the recess 5 of the first log half 2. The stave 7 is displaced, more exactly, from the centre of the recess 5 through a distance corresponding to the thickness of the insulation stave 7.

The log unit 1 includes at the end portion 4 with substantially circular cross-section a groove 8 on its upper surface, and a tongue (concealed) on its lower surface.

Owing to the aforesaid centre-cut, the log halves 2 and 3 include groove halves 9. The insulation stave 9 is so oriented relative to the log halves 2 and 3 that the upper surface of the stave 7 is located on the same level as the bottom of the groove halves 9. It further appears from FIG. 2 that the lower surface of the insulation stave 7 now is on the same level as the top of the tongue halves 10. Thereby a wide groove is formed upwardly and a wide tongue downwardly on the log unit 1 which in mounted state co-operate with grooves and tongues of adjacent units.

Figure 2:
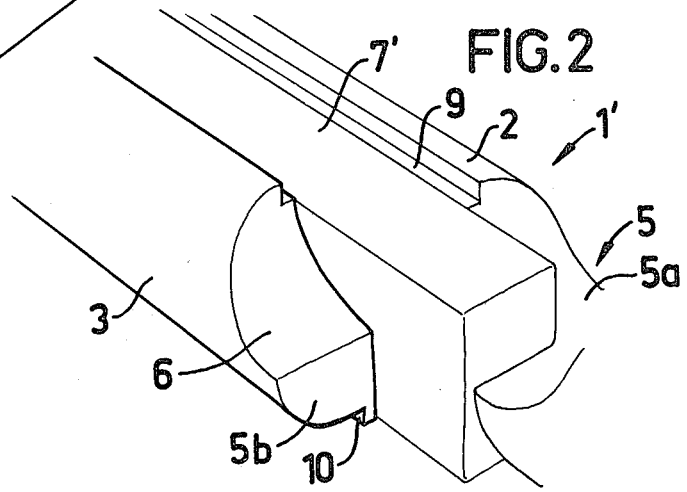
FIG. 2 is a perspective view from the other direction of a slightly modified log unit according to the invention.

In FIG. 2 a slightly modified log unit 1' is shown. Its structure in principle corresponds entirely to that of the unit 1. The feature distinguishing unit 1' from unit 1 is the extension of the insulation stave 7. At the embodiment according to FIG. 2, the insulation stave 7' extends all the way to the centre of recess 5*a*. This extension of insulation stave 7' also is indicated in FIG. 1 by dashed lines.

Figure 3:
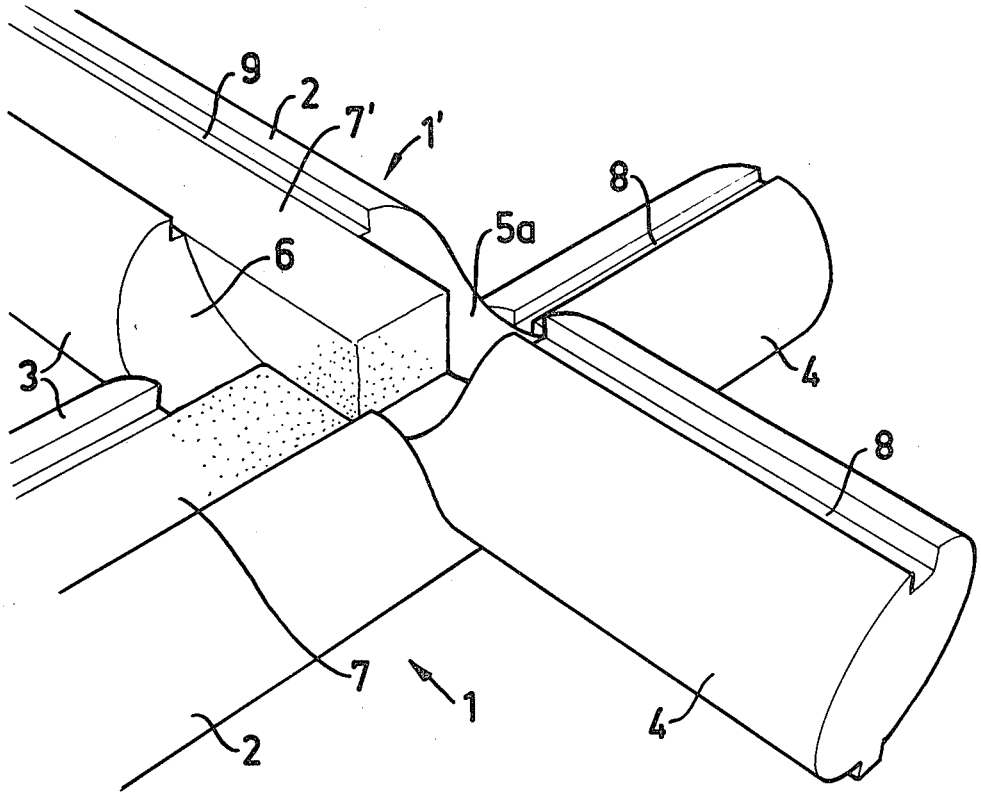
FIG. 3 is a perspective view of two jointed log units according to the invention.

In FIG. 3 is shown how the log units 1 and, respectively, 1' are joined one to the other.

As appears from FIG. 3, the inner part of the circular portion 4 is taken up in the recess 5*a* of an underlying intersecting log unit 1. The end of the log half 3 of a unit 1' located above is taken up in the recess 6 of an underlying intersecting unit 1.

In mounted state of the log units 1 and, respectively, 1' the insulation staves 7,7' overlap one another, so that no thermal bridge is formed in the corner joint structure. As already pointed out, the insulation staves 7,7' extend differently in the units 1 and, respectively, 1'. Due to the fact that the insulation stave 7 of the log unit 1 is displaced away from the recess 5*a*, a space is formed in which the insulation stave 7' can be received, whereby the inner longitudinal side of the stave 7' abuts the end surfaces of the insulation stave 7 of the underlying intersecting unit 1.

When constructing a corner joint structure according to FIG. 3, the tongue halves 10 and the lower surfaces of the insulation staves 7,7' of a unit located above abut the groove halves 9 and the upper surfaces of the staves 7,7' of an underlying unit in the same vertical plane. Besides, grooves 8 and tongues of end portions 4 located above co-operate with each other.

The insulation being of self-supporting type, the entire log unit 1,1' is self-supporting, which implies, that the corner joint structure can be constructed without additional bearing structural members, for example in the form of studs.

The end portion 4 of the log unit, of course, may vary in length.

At the embodiment shown, the recesses 5*a* are perpendicular to the longitudinal direction of the log unit 1,1'. Within the scope of the invention, however, nothing objects to designing the recesses 5*a* so as to form other angles relative to the longitudinal direction of the log units 1,1'. This is necessary when hexagonal or octagonal buildings are to be constructed.

It also can be imagined, for example, to replace the inner log half 3 by a plate-shaped wall facing, which is attached on the inside of the insulation staves 7,7' after the construction of the corner joint structure.

It also is possible to entirely abandon one of the log halves 2 or 3, in cases when the log units are to be used at additional insulation.

Figure 4:
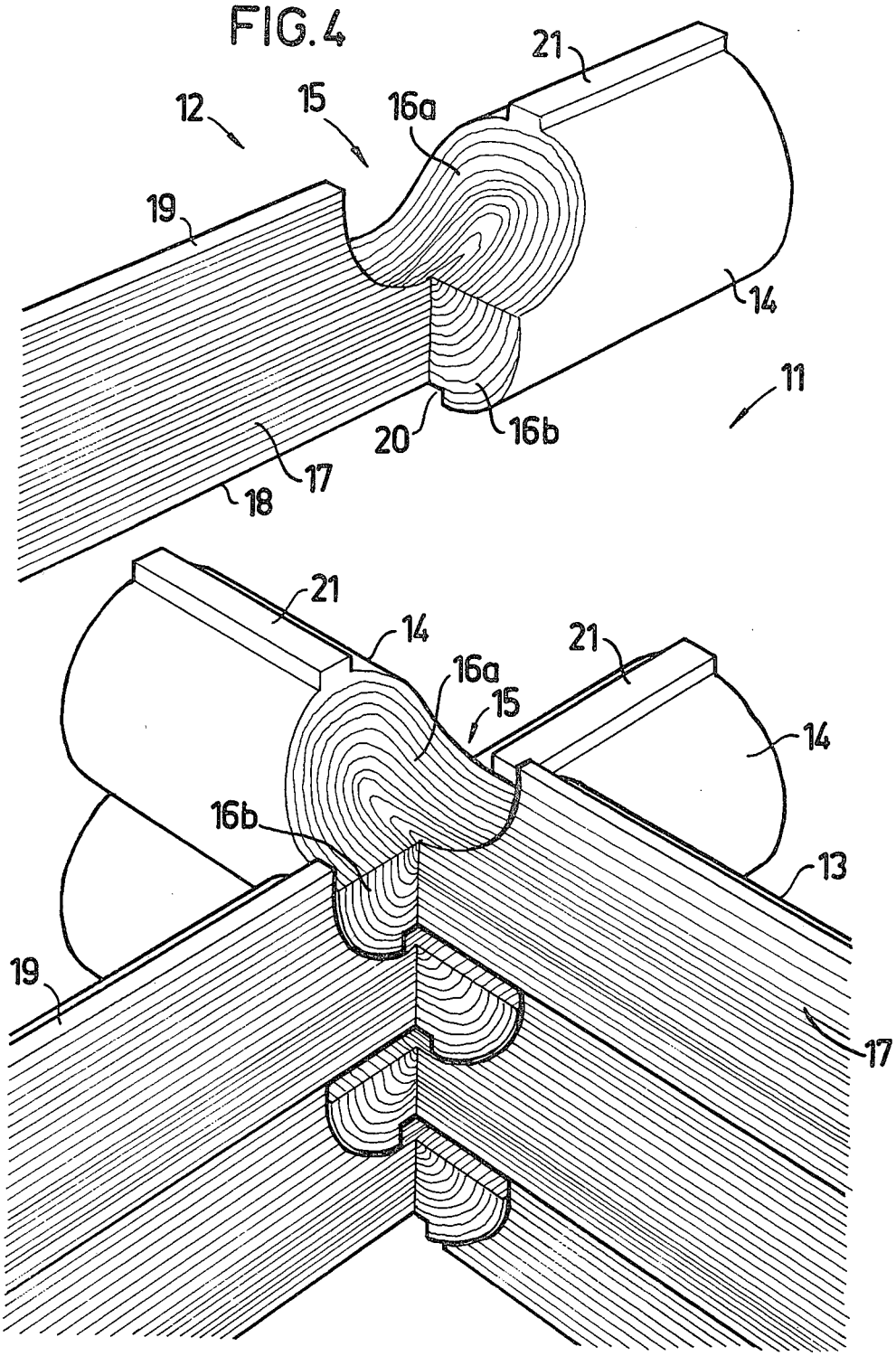
FIG. 4 shows a further variant of log units according to the invention and how they are joined together.

The corner joint structure 11 shown in FIG. 4 comprises a number of cylinder-turned log units 12.

The portion 13 of the unit 12 located inside of the joint proper has semi-circular cross-section, while the portion 14 located outside the joint has circular basic cross-section. The transition 15 between these two portions 13 and 14 consists of an arc-shaped recess 16*a* with the same curvature radius as portion 14 with circular basic cross-section of the unit 12 and of a plane surface 16*b* with the basic configuration of a quarter of a circle. The portion 16*b* has perpendicular extension relative to the plane surface 17 of the portion 13 with semi-circular cross-sectional shape.

The portion 13 includes grooves 18 and tongues 19 for co-operation with units located below and, respectively, above.

Also the portion 14 includes grooves 20 and tongues 21 for corresponding co-operation. These grooves 20 and tongues 21, however, are twice as wide as the grooves and tongues in portion 13.

It appears clearly from the Figure, how the log units 12 are joined together in the same vertical plane. The grooves 18 and 20 of one log unit, thus, take up the tongues of an underlying log unit, while the tongues 19 and 21 are taken up in the grooves of a unit located above.

The joining together of two log units forming a right angle with one another also is clearly apparent from the Figure. The lower innermost part of the transition 15 between the portions 13 and 14 which has semi-circular cross-section and is turned through 90° relative to the portion 13, is taken up in the arc-shaped recess 16*a* of an underlying unit.

As the recess 16*a* has a maximum depth corresponding to about half the height of the log unit, and a curvature radius corresponding to the curvature radius of portion 14 with circular cross-section, the transition part fits precisely into the recess 16*a* of an underlying unit with perpendicular extension relative to the unit located above.

As the transition part also includes a plane portion 16*b* with a cross-section of one quarter of a circle, the corner joint structure has on its inside two plane surfaces, which meet at a right angle. This implies that the log units 12 can be attached on a stud construction in principle as easily as a normal board boarding. As, besides, the facing looks like a construction of full round timber, also a substantial saving of material is obtained in addition to the afore-mentioned assembly-technical advantage.

It is not only for appearance reasons that full logs shall be visible in the corner joint structure. Due to the fact that the portions 4 have circular cross-section with a groove 20 abutting on both sides of a tongue 21 of an underlying unit, a much better engagement between the portions 14 than between the portions 13 is obtained. Thereby the ends of the log units are guided better, which is extremely important, because wood is a "living" material. If the log units 12 would have had semi-circular cross-section all the way out to the ends, the risk would increase that the engagement between the log units 12 ceases to exist or is deteriorated, because the units 12 often have a tendency of turning.

The corner joint structure is advantageous also with respect to shrinkage and expansion, because it does not give rise to any displacement in longitudinal direction of an intersecting unit.

In order to safely prevent the formation of radial cracks permitting water to penetrate in, preferably grooves in longitudinal direction of the units 12 can be provided in the groove 20 and in the portion 14 with circular basic cross-section of the tongue 21. The portion 14 thereby may shrink without giving rise to through cracks.

At the manufacture of the unit 12 shown in the Figure, a unit with semi-circular basic cross-section is obtained "into the bargain", which unit can be applied as boarding between the corner joints. Thereby a surface is covered which is almost twice as great as obtained when using log units with circular cross-section along their entire length.

As appears from FIG. 4, the log units 12 also can be used in so-called self-supporting structures, because the units are interlocked relative one another by groove and tongue.

At the above embodiments, the log units are cylinder-turned. Within the scope of the invention also log units with other cross-sectional shapes can be imagined, and the units also may be made of other materials. The recesses in the corner joint structure may have a shape other than that stated above, with the restriction that intersecting units shall have a shape fitting in the recess.

We claim:

1. A log unit, preferably of wood, which in at least one end zone includes a portion (4,14) with full cross-section while the portion inside thereof (2, 3, 7, 2, 3, 7', 13) in section constitutes a part with half a cross-section, characterized in that the transition (5, 15) between the portion (4, 14) with full cross-section and the portion inside thereof consists of a recess (5*a*, 16*a*), which extends in the longitudinal direction of the unit (1, 1', 12)

and in which the portion (4, 14) with full cross-section fits, and of a plane surface (5*b*, 16*b*), which in principle is one quarter of the cross-sectional area for the full cross-section and extends substantially perpendicularly to the longitudinal direction of the unit (1, 1', 12) and connects to the plane surface (17) of the portion (2, 13) with half a cross-section, and that the unit (1, 1', 12) is provided with groove and tongue (8, 9, 10, 18, 19, 20, 21) preferably along the entire length of the unit (1, 1', 12).

2. A unit as defined in claim 1, characterized in that a stave of insulation (7,7') is attached on the plane surface of the portion with half a cross-section.

3. A unit as defined in claim 2, characterized in that on the side of the insulation stave (7,7') remote from the portion (2) with half a cross-section a second portion (3) with half a cross-section is attached, the plane surface of which abuts the insulation stave (7,7').

4. A unit as defined in claim 3, characterized in that said second portion (3) with half a cross-section is displaced in its longitudinal direction away from the surface (5*b*) through a distance corresponding to the width of the insulation stave (7,7').

5. A unit as defined in any one of the claims 2–4, characterized in that the insulation stave (7) is displaced away from the surface (5*b*) through a distance corresponding to the width of the insulation stave (7).

6. A unit as defined in any one of the claims 2–4, characterized in that the insulation stave (7') extends all the way to the plane surface (5*b*).

7. A unit as defined in any one of claims 1, 2, 3, or 4, characterized in that the portion (4,14) with full cross-section and the portions (2,3,17) with half a cross-section are cylinder-turned.

8. A corner joint structure build up of log units according to any one of claims 1, 2, 3, or 4, characterized in that a plurality of said log units (1,1',12) are arranged in two vertical planes substantially perpendicular to each other, and that the portion (4,14) with full cross-section of one unit is taken up in the recess (5*a*,16*a*) of an underlying unit intersecting said firstmentioned unit.

9. A corner joint structure as defined in claim 8, characterized in that the insulation staves (7,7') of two adjacent intersecting units overlap one another.

10. A unit as defined in claim 2 wherein said stave of insulation is rectangular in cross-section.

11. A unit as defined in claim 2 wherein said stave of insulation is attached by glueing.

12. A unit as defined in claim 3 wherein said second portion is attached by glueing.

* * * * *